United States Patent [19]

Samuels

[11] Patent Number: 4,843,987

[45] Date of Patent: Jul. 4, 1989

[54] HEEL COUNTERACTING AIRFOIL

[76] Inventor: Harris J. Samuels, 2981 Jackson Ave., Miami, Fla. 33133

[21] Appl. No.: 178,620

[22] Filed: Apr. 7, 1988

[51] Int. Cl.[4] ..... B63B 1/12

[52] U.S. Cl. ..... 114/9.1; 114/103

[58] Field of Search ..... 114/39.1, 61, 121, 102, 114/103, 162

[56] References Cited

U.S. PATENT DOCUMENTS

| | | | |
|---|---|---|---|
| 2,392,165 | 1/1946 | Livingston | 114/162 |
| 3,247,821 | 4/1966 | Graig | 114/102 |
| 4,280,428 | 7/1981 | Werner, Jr. | 114/61 |
| 4,341,176 | 7/1982 | Orrison | 114/102 |
| 4,453,483 | 6/1984 | Shallenberger | 114/102 |
| 4,530,301 | 7/1985 | Latham | 114/102 |
| 4,563,970 | 1/1986 | Walker | 114/102 |
| 4,582,013 | 4/1986 | Holland, Jr. | 114/102 |
| 4,624,203 | 11/1986 | Ferguson | 114/102 |
| 4,649,848 | 3/1987 | Belvedere | 114/103 |
| 4,664,050 | 5/1987 | Clauser | 114/102 |
| 4,702,186 | 10/1987 | Tiede | 114/39.1 |

FOREIGN PATENT DOCUMENTS

| | | | |
|---|---|---|---|
| 3401787 | 11/1984 | Fed. Rep. of Germany | 114/103 |
| 95293 | 6/1982 | Japan | 114/103 |
| 200094 | 9/1986 | Japan | 114/103 |

*Primary Examiner*—Sherman D. Basinger
*Assistant Examiner*—Stephen P. Avila
*Attorney, Agent, or Firm*—Robert G. Rosenthal

[57] ABSTRACT

A wing type airfoil is used to propel a vessel. The airfoil comprises a mast, a counterbalancing airfoil and a driving airfoil. The mast is elongate and has upper and lower portions, the lower portion is adapted to be connected to the vessel and extends upwardly therefrom. The counterbalancing airfoil has a first angle of attack orientation and is connected to the mast. The driving airfoil has a second angle of attack orientation and is connected to the mast below the counterbalancing airfoil. The counterbalancing airfoil and the driving airfoil have different angles of attack which are independently adjustable with respect to the vessel.

10 Claims, 3 Drawing Sheets

HEEL COUNTERACTING AIRFOIL

FIELD OF THE INVENTION

The present invention relates to vessels and vehicles having an airfoil or sail for propulsion.

BACKGROUND OF THE INVENTION

It is known to use a sail to propel a sailing vessel, ice boat, land sailing vehicle and the like. However, the efficiency of even the most advanced sail designs remains relatively low. In part, this is due to the fact that as the wind fills the sail, it tends to cause the hull to move from the vertical and to lean to one side or to "heel". Sail efficiency declines as the vessel heels because the wind spills out of the sail before it can significantly contribute to forward propulsion and further because ballast is added to maintain the vessel upright to counteract the tendency of the hull to heel which decreases vessel speed.

In an attempt to increase sail efficiency airfoils were adapted for use on sail equipped vessels. Airfoils offer the advantage over conventional sails in that they approach a more perfect foil design. However, they still do not address the problems associated with the effects of heeling. Known airfoils may be rigid or flexible in construction and may be of reversible chamber. Exemplary of the art of wing type sails are U.S. Pat. Nos. 4,563,970; 4,341,176; 4,530,301; 4,624,203 and 4,649,848, the disclosures of which are hereby incorporated by reference.

In view of the foregoing it is an object of the present invention to provide an airfoil adapted to be used to propel a vessel and which reduces the tendency of the vessel to tilt or to heel.

Another object of the present invention is to provide an airfoil adapted to be used to propel a vessel which increases safety by reducing the tendency of the vessel to overturn.

A further object of the present invention is to provide an airfoil adapted to be used to propel a vessel that reduces the vessel ballast requirements.

A still further object of the present invention is to provide an airfoil adapted to be used to propel a vessel that increases the ability of the vessel to reach its planing hull speed.

A still further object of the present invention is to provide an auxiliary wind propulsion system that can be adapted for use on existing motor vessels with a minimum of hull and ballast modification.

A still further object of the present invention is to provide a mechanism for the aerodynamic braking of a vessel.

SUMMARY OF THE INVENTION

To accomplish the foregoing objects, there is provided a wing type airfoil that is adapted to propel a vessel such as a sail boat, land vehicle, ice boat and the like. The airfoil comprises a mast, a counterbalancing airfoil means and a driving airfoil means. The mast is elongate and has upper and lower portions, the lower portion is adapted to be connected to the vessel and extends upwardly therefrom. The counterbalancing airfoil means has a first angle of attack orientation and is connected to the mast. The driving airfoil means has a second angle of attack orientation and is connected to the mast below the counterbalancing airfoil means. The counterbalancing and driving airfoil means have different angles of attack which are independently adjustable with respect to each other and with respect to the vessel.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE ILLUSTRATED EMBODIMENT

While the present invention will be described more fully hereinafter, it is to be understood at the outset that persons of skill in the art may modify the invention herein described while still achieving the favorable results of this invention. Accordingly, the description which follows is to be understood as being a broad teaching disclosure directed to pesons of skill in the appropriate arts, and not as limiting upon the present invention.

Those skilled in the art will know that a sail is an airfoil the lift of which can be reduced to two components. The first is a vector parallel to the course of and driving the vessel. The second is a vector perpendicular to the course of the vessel and tending to overturn it. The force tending to overturn the vessel acts at the center of effort of the sail. The overturning moment is the product of the height of the center of effort over the center of lateral resistance of the hull of the vessel times the overturning force. Traditionally, the overturning moment is neutralized at some angle of heel by the vessel's ballast and buoyancy.

The sail of a vessel must be "trimmed" or oriented with respect to the apparent wind to produce the desired driving effect. The trim in a conventional fabric sail is usually accomplished mechanically by the application of tension on the "sheets" or lines which are attached to the sail to obtain the desired angle of the sail to the apparent wind. Rigid airfoils may additionally be aerodynamically "trimmed" through the use of ailerons and/or trim tabs.

Figure 1:
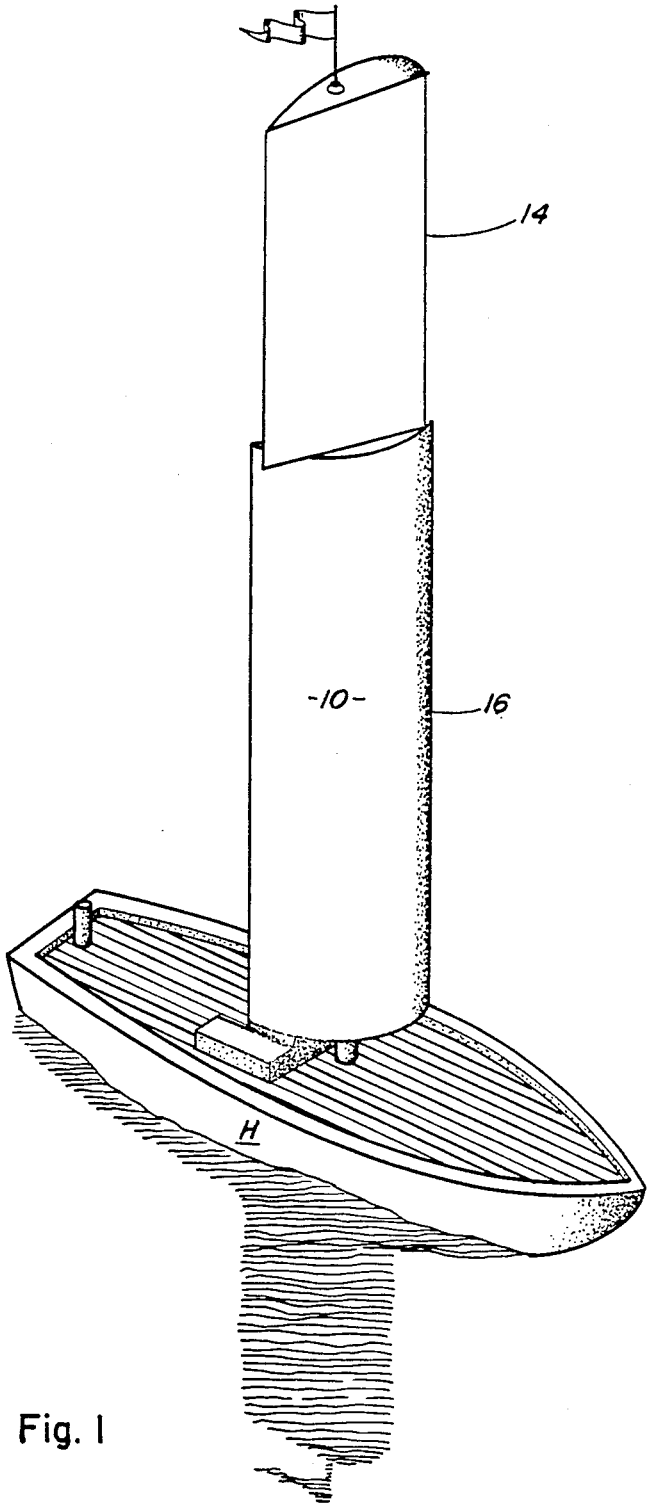
FIG. 1 is a perspective view of a sailing vessel on a port tack including the heel counteracting airfoil of the present invention.

Referring now more particularly to the drawings and specifically FIG. 1, the heel counteracting airfoil generally indicated at 10 is affixed to a sailboat hull H. The vessel is trimmed for port tack. It will be noted that while the specific embodiment illustrated shows the sail of the present invention used in combination with a marine sailboat hull, the invention is intended to be broad enough in scope so that extensions of the invention to iceboats, power sailing boats, and the like will be within the knowledge to those skilled in the art.

The wing type airfoil 10 comprises a mast 12, a counterbalancing airfoil means 14 and a driving airfoil means 16.

The illustrated mast 12 of the present invention is unstayed and is of conventional construction. The mast 12 is connected to the hull H by conventional means and extends substantially vertically therefrom. Details of the connection between the mast 12 and the hull H are well known to those of skill in the art and further discussion thereof is not deemed necessary.

The counterbalancing airfoil means or counterbalancing airfoil 14 is connected to the upper portion of the mast 12 and has a first angle of attack orientation. The counterbalancing airfoil means and driving airfoil means may be of variable camber. As used herein camber is meant to define the shape or curvature of each of the airfoil means 14, 16. More specifically, as illustrated in the drawings, each airfoil means has one curved side and one substantially flat side. The selection of which side will be flat and which side will be curved depends on the particular orientation of the vessel with respect to the apparent wind direction and whether or not a particular segment of the airfoil is to contribute to the counterbalancing airfoil means or driving airfoil means.

The counterbalancing airfoil means 14, comprises a plurality of independently camber adjustable segments **14*a* and 14*b*. Each segment 14*a*, 14*b* may be equipped with adjustable trim tabs 24 which serve to fine tune the counterbalancing airfoil means 14**. While the airfoil illustrated includes five segments, that number is arbitrary for purposes of illustration only. In practice the actual number of segments may be greater or less depending on the desired application.

The airfoil also includes a driving airfoil means or driving airfoil 16 having a second angle of attack orientation and is connected to the mast 12 below the counterbalancing airfoil means 14. The driving airfoil means 16 comprises a plurality of independently adjustable segments **16*a*, 16*b*, 16*c*. Each segment 16*a*, 16*b*, 16*c* may be equipped with adjustable trim tabs 26 which serve to fine tune the driving airfoil means 16**.

The operation of the airfoil will be described mathmatically as follows with reference to the following definitions:

a or ∢ A = The bearing of the vessel off the apparent wind

L(z) = The lift of the airfoil

D(z) = The driving force on the airfoil

H(z) = The heeling force on the airfoil

X(z) = Height of the airfoil center of effort over the center of lateral resistance of the hull (MC)

Z = u: counterbalancing airfoil

Z = 1: driving airfoil

Figure 2:
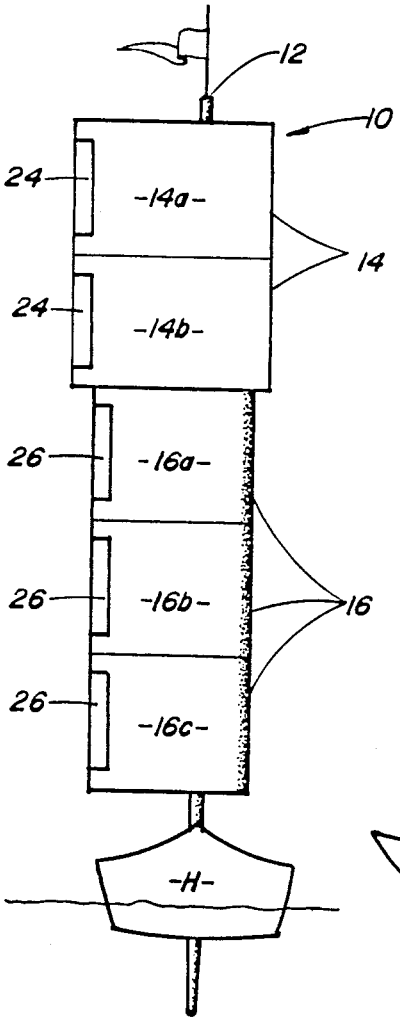
FIG. 2 is a front view of a sailing vessel on a port tack including the heel counteracting airfoil of the present invention.
Figure 3:
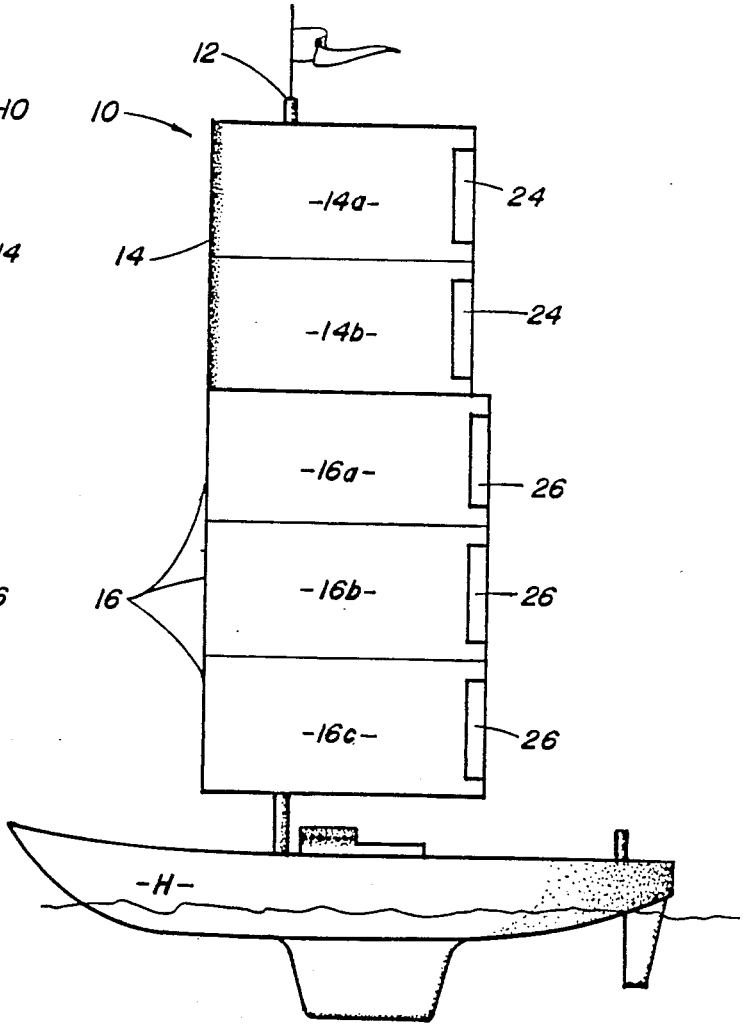
FIG. 3 is a left side view of a sailing vessel on a port tack including the heel counteracting airfoil of the present invention.
Figure 4:
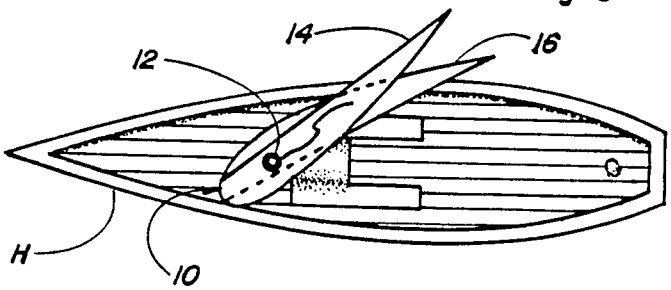
FIG. 4 is a plan view of a sailing vessel on a port tack including the heel counteracting airfoil of the present invention.
Figure 5:
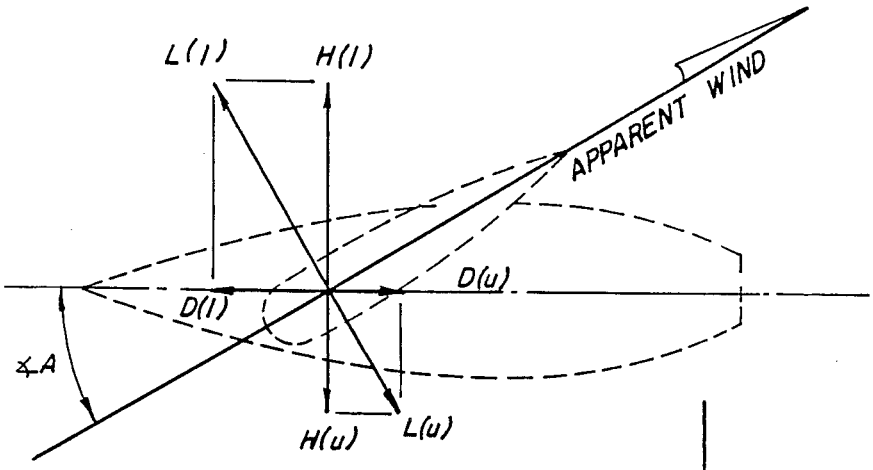
FIG. 5 is a schematic plan view of a sailing vessel on a port tack including the heel counteracting airfoil of the present invention and illustrating the force vectors operating on the airfoil.
Figure 6:
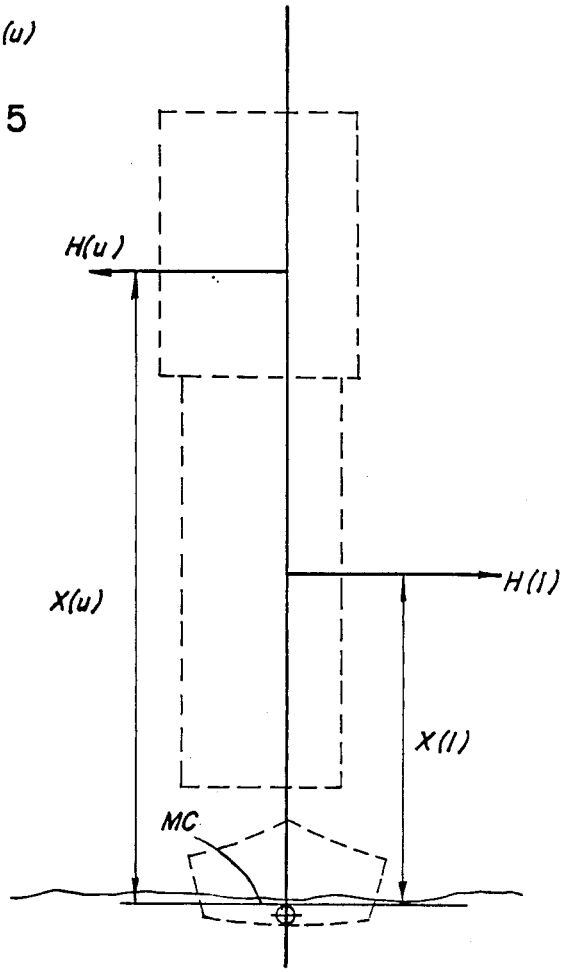
FIG. 6 is a schematic front view of a sailing vessel on a port tack and including the heel counteracting airfoil of the present invention and illustrating the force vectors operating on the airfoil.

Referring to FIGS. 5 and 6, L (1) is the lift to the airfoil provided by segments **16*a*, 16*b* and 16*c* of FIGS. 2 and 3. L(u) is the lift to the airfoil provided by segments 14*a* and 14*b*. L(1**) is greater than and in the opposite direction to L(u).

D(1) = L(1) sin (a) is the driving force imparted by the driving airfoil sections **16*a*, 16*b*, 16*c*. Similarly D(u) = -L(u) sin (a) is the retrograde force imparted by the counterbalancing airfoil sections 14*a*, 14*b*. The net driving force propelling the vessel is D(1**) − D(u).

H(1) = L(1) cos a is the heeling force imparted by the driving airfoil sections **16*a*, 16*b*, 16*c*. Similarly H(u) = -L(u) cos (a) is the righting force imparted by the counterbalancing airfoil sections 14*a*, 14*b*. Referring to FIG. 6, X(1) is the height of the center of effort CE(1) over the center of lateral resistance of the hull MC. The heeling moment imparted by the driving airfoil is H(1) x X(1). Similarly, the righting moment of the counterbalancing airfoil segments is H(u) × X(u). The total heeling moment on the vessel is [H(1) × X(1**)] − [H(u) × X(u)]. In practice the orientation of the airfoil segment's angle of attack and their trim would be adjusted for maximum speed, acceptable heel and/or braking. For example, aerodynamic braking of the vessel may be achieved by reversing the angle of attack of the driving airfoil means and the counterbalancing airfoil means while the vessel is on any given course.

The reader will note that the ratio of the surface areas of the counterbalancing airfoil means and the driving airfoil means is adjustable so that the vessel may be rigged in accordance with the prevailing wind conditions. In addition, as with a conventional sail, the airfoil means 14, 16 are secured to mast 12 so as to pivot thereabout. The foregoing enables the angle of the airfoil to be adjusted to obtain a proper orientation with respect to the prevailing wind direction to maximize forward propulsion at a given angle of attack of the vessel. In addition, when circumstances warrant, such as in light wind conditions, sections of the counterbalancing airfoil means can be configured so as to serve as additional driving airfoil means.

It is important to note that the area of the driving airfoil segments can be greater than that of the counterbalancing airfoil segments and the net driving force greater than zero when the heeling moment is neutralized. This is accomplished because of the differences in leverage due to the heights of centers of effort of the driving airfoil segments and counterbalancing airfoil segments.

The foregoing embodiments and examples are to be considered illustrative, rather than restrictive of the invention, and those modifications which come within the meaning and range of equivalence of the claims are to be included therein.

That which is claimed is:

1. A wing type airfoil adapted to be used to propel a vessel such as a sailboat, land vehicle, ice boat and the like in a substantially upright manner, and comprising:

an elongate mast having upper and lower portions, said lower portion adapted to be connected to the vessel and extending upwardly therefrom, counterbalancing airfoil means having a first angle of attack orientation and being connected to said mast;

a driving airfoil means for providing substantial driving force to the vessel having a second angle of attack orientation and being connected to said mast below said counterbalancing airfoil means, whereby the vessel tends to the upright and is propelled when wind blows past said airfoil.

2. A wing type airfoil according to claim 1 wherein said counterbalancing airfoil means has a first predetermined angle of attack orientation and said driving airfoil means has a second predetermined angle of attack orientation.

3. A wing type airfoil according to claim 1 wherein both said counterbalancing airfoil means and said driving airfoil means further include a camber that is adjustable.

4. A wing type airfoil according to claim 1 wherein the surface areas of said counterbalancing airfoil means and said driving airfoil means are independently adjustable, whereby the driving forces and righting forces operating on said airfoil may be adjusted so as to maintain the vessel in a substantially upright position.

5. A wing type airfoil according to claim 3 wherein the camber of said counterbalancing airfoil means and said driving airfoil means substantially oppose each other.

6. A wing type airfoil according to claim 1 wherein said mast is fixedly mounted to said vessel.

7. A wing type airfoil according to claim 1 wherein the angle of attack of said counterbalancing airfoil means and of said driving airfoil means is independently adjustable.

8. A wing type airfoil according to claim 1 wherein said counterbalancing airfoil means and said driving airfoil means are comprised of a plurality airfoil segments.

9. A wing type airfoil adapted to be used to propel a vessel such as a sailboat, land vehicle, ice boat and the like in a substantially upright manner and comprising:

an elongate mast having upper and lower portions, said lower portion adapted to be connected to the vessel and extending substantially vertically upward therefrom, a counterbalancing airfoil means for providing substantial driving force to the vessel having a first adjustable angle of attack orientation and being pivotally connected to the upper portion of said mast, a driving airfoil means having a second adjustable angle of attack orientation and being pivotally connected to said mast immediately below said counterbalancing airfoil means, said counterbalancing airfoil means and said driving airfoil means being interconnected so that the angle of attack orientation of said counterbalancing airfoil means and said driving airfoil means substantially oppose each other, whereby the vessel tends to the upright and is propelled when wind blows past said airfoil.

10. A wing type airfoil according to claim 9 wherein said counterbalancing airfoil means and said driving airfoil means are contiguously connected to said mast.

* * * * *